US007025122B2

(12) United States Patent
You-Tien

(10) Patent No.: US 7,025,122 B2
(45) Date of Patent: Apr. 11, 2006

(54) HEAT SINK ELEMENT COUPLING STRUCTURE (2)

(76) Inventor: Lin You-Tien, 5F/No. 8, Lane 81, Chung-Pin Road, Hsing-Chung City, Taipei Hsien (TW)

( * ) Notice: Subject to any disclaimer, the term of this patent is extended or adjusted under 35 U.S.C. 154(b) by 234 days.

(21) Appl. No.: 10/666,962

(22) Filed: Sep. 19, 2003

(65) Prior Publication Data

US 2004/0112569 A1 Jun. 17, 2004

(30) Foreign Application Priority Data

Nov. 14, 2002 (TW) ..... 91218323 U

(51) Int. Cl.
*F28F 7/00* (2006.01)

(52) U.S. Cl. ..... 165/80.3; 165/185; 361/709; 361/704; 174/16.3; 857/722

(58) Field of Classification Search ..... 165/80.3, 165/185; 361/697, 704, 710, 703, 709; 257/706, 257/722; 174/16.3
See application file for complete search history.

(56) References Cited

U.S. PATENT DOCUMENTS 6,336,498 B1 * 1/2002 Wei ..... 165/80.3
6,340,056 B1 * 1/2002 Huang et al. ..... 165/185
6,386,275 B1 * 5/2002 Kuo et al. ..... 165/80.3
6,401,810 B1 * 6/2002 Kuo et al. ..... 165/185
6,449,160 B1 * 9/2002 Tsai ..... 361/709
6,474,407 B1 * 11/2002 Chang et al. ..... 165/80.3
6,607,023 B1 * 8/2003 Ho et al. ..... 165/78
6,607,028 B1 * 8/2003 Wang et al. ..... 165/185
6,619,381 B1 * 9/2003 Lee ..... 165/78
6,639,802 B1 * 10/2003 Dong et al. ..... 361/709
6,644,386 B1 * 11/2003 Hsu ..... 165/80.3
6,644,397 B1 * 11/2003 Shen ..... 165/185
6,651,733 B1 * 11/2003 Horng et al. ..... 165/80.3
6,655,448 B1 * 12/2003 Lin ..... 165/80.3
6,672,379 B1 * 1/2004 Wang et al. ..... 165/185
6,729,384 B1 * 5/2004 Lo ..... 165/80.3
6,729,385 B1 * 5/2004 Huang et al. ..... 165/80.3

(Continued)

*Primary Examiner*—Terrell McKinnon

(57) ABSTRACT

A heat sink element coupling structure comprised of a "+" or a "+"-shaped horizontal offset disposed on the upper and lower or left and right two sides or a certain position on the lateral edge at the center portion of an L-shaped or a horizontally oriented U-shaped heat sink unit (element) plate. The structure includes inverted U-shaped or U-shaped appendages situated at the anterior section of the horizontal offsets as well as one or two wing-shaped lock tabs formed at the two sides or either the left or the right side of the inverted U-shaped or U-shaped appendages. Also included in the structure are one or two cutaways at the two sides or either the left or the right side of the horizontal offsets and a downward or upward lock tab at the two sides or the either left or right of the anterior edge of the horizontal offsets. The wing-shaped lock tabs or lock tabs of each coupling structure at the two sides of one heat sink unit (element) are fitted onto the horizontal offsets of the next correspondingly situated heat sink unit (element) such that the one or two wing-shaped lock tabs or lock tabs on the front heat sink unit (element) become engaged onto the lateral edge of the adjacent other heat sink unit (element), the horizontal offsets at the two lateral edges of the its plate or the cutaway at one side, thereby enabling several or numerous heat sink elements to be interconnected at fixed horizontal distances and positions.

8 Claims, 13 Drawing Sheets

U.S. PATENT DOCUMENTS 6,754,079 B1 * 6/2004 Chang ..... 361/709
6,765,799 B1 * 7/2004 Huang ..... 361/709
2004/0040700 A1 * 3/2004 Tsai et al. ..... 165/185
2004/0069479 A1 * 4/2004 Yeh ..... 165/185
2004/0150955 A1 * 8/2004 You-Tien ..... 361/709
2004/0182543 A1 * 9/2004 Shao ..... 165/80.3
2005/0094375 A1 * 5/2005 Chiang et al. ..... 361/702

* cited by examiner

HEAT SINK ELEMENT COUPLING STRUCTURE (2)

BACKGROUND OF THE INVENTION

1) Field of the Invention

The invention herein relates to heat dissipation fixtures, specifically a heat sink element coupling structure (2) designed for continuous punch fabrication in a rapid, volume manufacturing process that reduces production costs and, furthermore, is of simple structure, quick to assemble, and of sturdy construction whether interconnecting a few or numerous elements to assemble heat sinks of differing lengths and dimensions.

2) Description of the Prior Art

The invention herein is a further improvement of U.S. Pat. No. 10/357,036; Japan Patent No. 3096005; and Germany Patent No. 20301981.4, specifically a heat sink element coupling structure (2) that provides for greater structural simplicity as well as more rapid fabrication and assembly and, furthermore, sturdier interconnection, while facilitating the serial assembly of heat sinks of different lengths and dimensions. The applicant of the invention herein was granted new patent rights by the patent bureaus of Japan and Germany for "Heat Sink Element Coupling Structure," which already effectively provides for greater structural simplicity, rapid fabrication and assembly and, furthermore, sturdier interconnection in the serial assembly of heat sinks of different lengths and dimensions. However, there were minor problems affecting maximum rates of continuous punch fabrication and production. Following extensive research and testing, the pivotal area of difficulty was the structure of the horizontal offset hook elements, which were further perfected to develop the heat sink element coupling structure (2) of the present invention.

SUMMARY OF THE INVENTION

The objective of the invention herein is to provide a heat sink element coupling structure (2) appropriate for continuous punch fabrication in a rapid, volume manufacturing process that reduces production costs and, furthermore, is of simple structure, quick to assemble, and of robust construction whether interconnecting a few or numerous elements, while enabling the assembly of heat sinks having different lengths and dimensions.

Said heat sink element coupling structure is comprised of a "+" or a "+"-shaped horizontal offset disposed on the upper and lower or left and right two sides or a certain position on the lateral edge at the center portion of an L-shaped or a horizontally oriented U-shaped heat sink unit (element) plate, including inverted U-shaped or U-shaped appendages situated at the anterior section of the horizontal offsets as well as one or two wing-shaped lock tabs formed at the two sides or either the left or the right side of said inverted U-shaped or U-shaped appendages; or, including one or two cutaways at the two sides or either the left or the right side of said horizontal offsets, and a downward or upward lock tab at the two sides or the either left or right of the anterior edge of said horizontal offsets; the wing-shaped lock tabs or lock tabs of each coupling structure at the two sides of one heat sink unit (element) are fitted onto the horizontal offsets of the next correspondingly situated heat sink unit (element) such that the one or two wing-shaped lock tabs or lock tabs on said front heat sink unit (element) become engaged onto the lateral edge of the adjacent other heat sink unit (element), the horizontal offsets at the two lateral edges of the its plate, or the cutaway at one side, thereby enabling a few or numerous heat sink elements to be interconnected at fixed horizontal distances and positions; said coupling structure also includes a vertical lock edge that is folded downward or upward at the rear side of the two wing-shaped lock tabs on each coupling structure; or, the anterior section of each horizontal offset does not have to be folded into inverted U-shaped or U-shaped appendages, and a vertical lock tab is folded downward or upward at the rear sides of the two wing-shaped lock tabs.

The brief description of the drawings below are followed by the detailed description of the invention herein,

BRIEF DESCRIPTION OF THE DRAWINGS

FIG. 1~1 is a partial isometric drawing of another most preferred heat sink unit (element) embodiment of the first embodiment of the invention herein, as viewed from the left side (not shown in the drawing, the right side is identical).

FIG. 1~2 is a partial isometric drawing of another most preferred heat sink unit (element) embodiment of the first embodiment of the invention herein, as viewed from the left side (not shown in the drawing, the right side is identical).

FIG. 2 is a partial isometric drawing of the heat sink unit (element) embodiment shown in FIG. 1 during interconnection, as viewed from the left side (not shown in the drawing, the right side is identical).

DETAILED DESCRIPTION OF THE INVENTION

Figure 1:
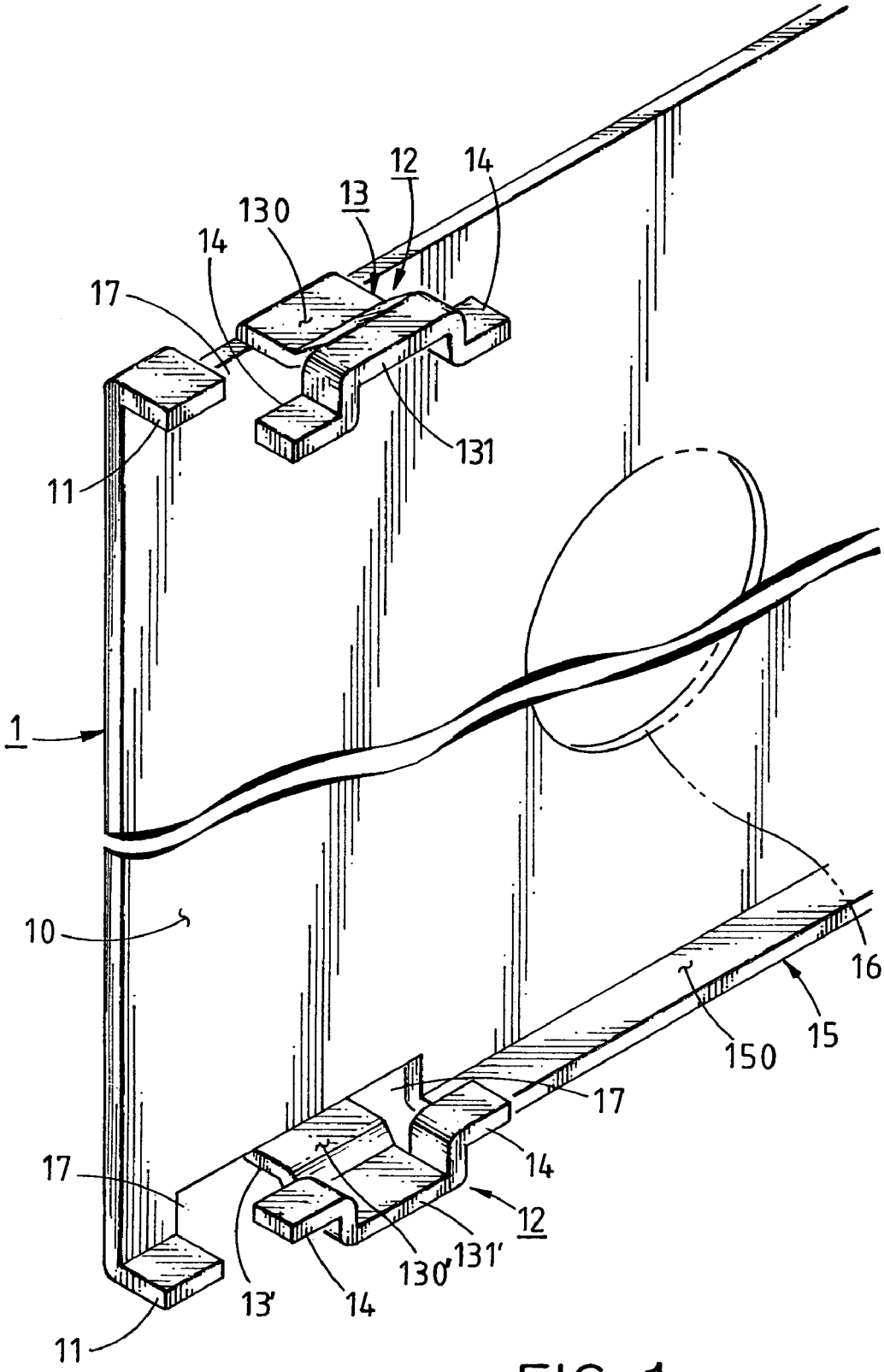
FIG. 1 is a partial isometric drawing of the first embodiment heat sink unit (element) of the invention herein, as viewed from the left side (not shown in the drawing, the right side is identical).
Figure 3:
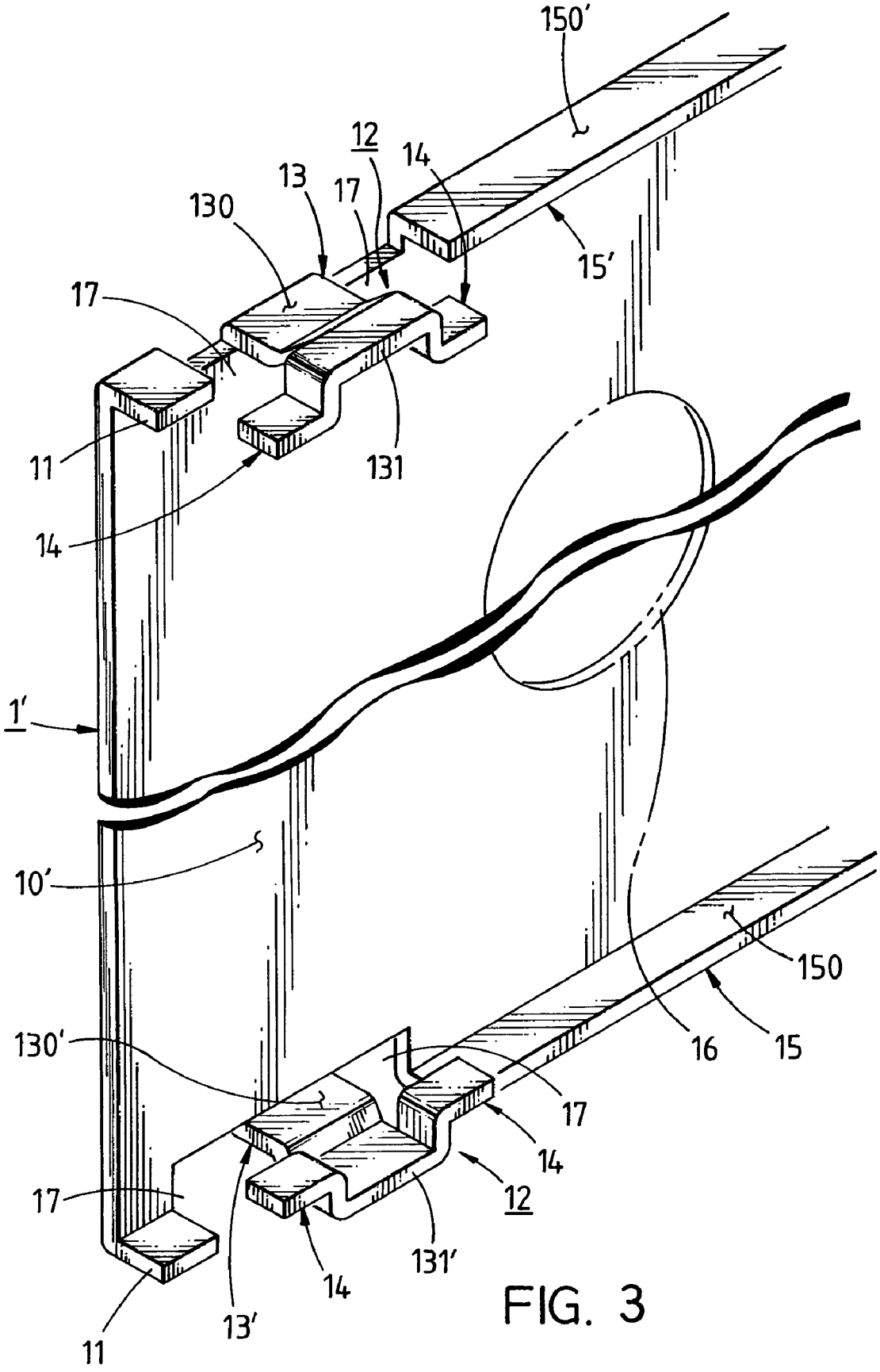
FIG. 3 is a partial isometric drawing of another most preferred heat sink unit (element) embodiment of the first embodiment of the invention herein, as viewed from the left side (not shown in the drawing, the right side is identical).

Referring to FIG. 1 and FIG. 3, the partial isometric drawing of the first embodiment heat sink unit (element) 1 and 1' of the invention herein, as viewed from the left side. Said heat sink element 1 consists of an aluminum, copper, or other comparable metal material that is punch fabricated into shape. Furthermore, it consists of an L-shaped plate 10 of appropriate dimensions having an horizontal fold 15 formed along one lateral edge (the upper, lower, left, or right lateral edge) or an L-shaped plate 10 having a plurality of additionally punched holes 16; or a horizontally oriented plate 10' of appropriate dimensions having an horizontal fold 15' and 15 formed along two lateral edges (the upper and lower or left and right), or a horizontally oriented U-shaped plate 10' having a plurality of additionally punched holes 16; and a minimum of one or more coupling structures 12 disposed on the two sides (upper and lower ends or left and right ends) or a certain position at the center portion of said plates 10 and 10'; after a "+" or a "+"-shaped horizontal offset 13 and 13' is formed by bending the two sides of each coupling structure 12 at the upper and lower or left and right lateral edge of said L-shaped plate 10 or the horizontally oriented U-shaped plate 10', the anterior section of each said horizontal offset 13 and 13' is folded into an inverted U-shaped or U-shaped appendage 131 and 131', following which the two sides are folded outward to form wing-shaped lock tabs 14.

Figure 4:
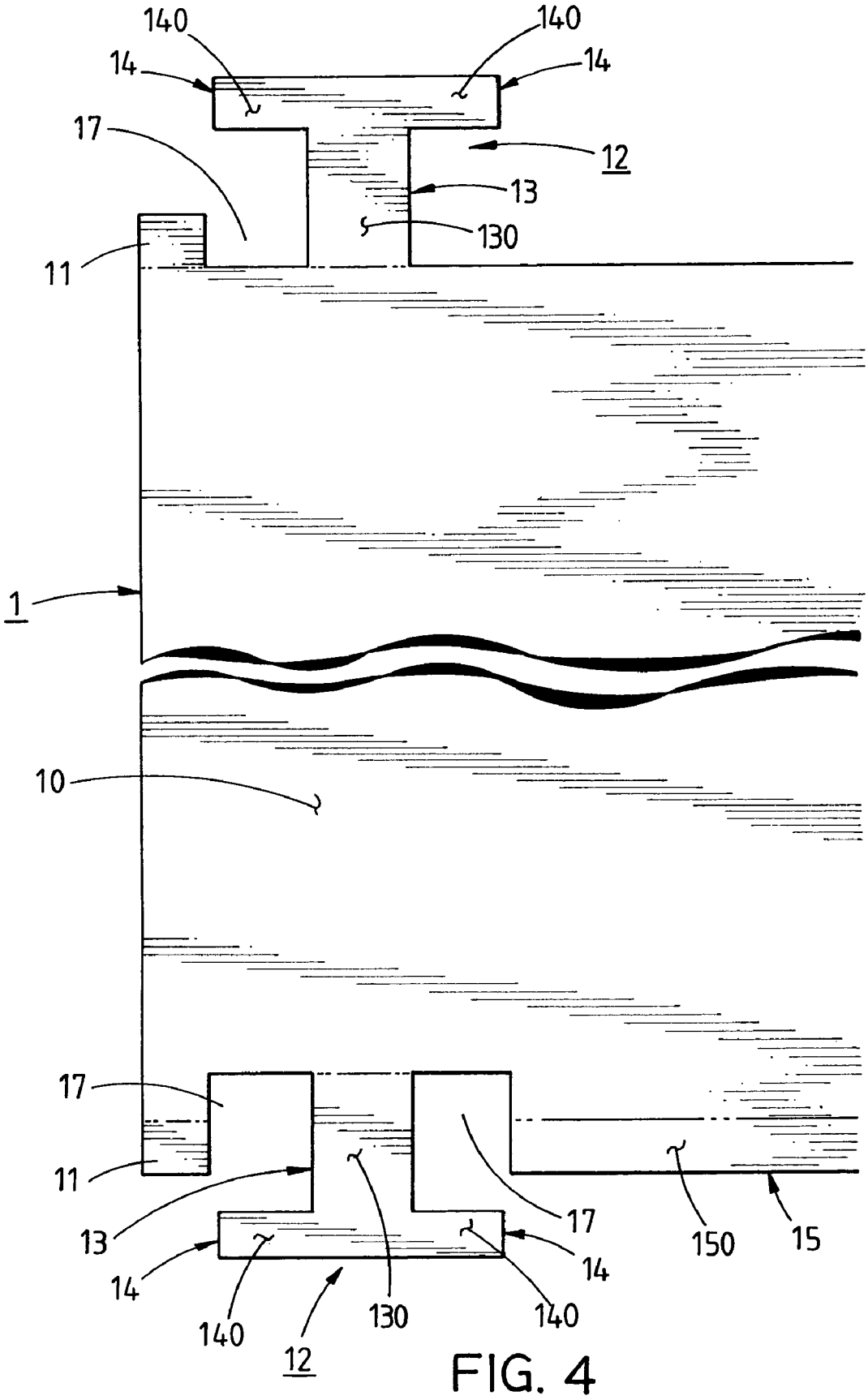
FIG. 4 is an orthographic drawing of the heat sink unit (element) embodiment shown in FIG. 1 in the flat, spread open state when fed as material.

Referring to FIG. 4, said coupling structure 12 facilitates overall production by being designed for a continuous punching and molding fabrication process in which the heat sink unit (element) 1 shown in FIG. 1 is as indicated in FIG. 4 when fed as material. The planar members 130 and 130' of the "+" or "+"-shaped horizontal offsets 13 and 13' as well as the planar member 140 of the two wing-shaped lock tabs 14 are both large T-shaped flat constructs and, furthermore, a cutaway 17 slightly wider than two or one of said one wing-shaped lock tabs 14 is also punched between said horizontal offset 13' planar member 130' and an horizontally folded planar member 150 formed along the lower side (one side) of the L-shaped plate 10; following which, said planar members 130 and 130' are formed into the "+" or "+" shapes, the inverted U-shaped or U-shaped appendages 131 and 131' as well as the two wing-shaped lock tabs 14 are folded, and finally said "+" or "+"-shaped planar members 130 and 130' and also said horizontally folded planar member 150 are both bent perpendicularly as shown in FIG. 1, which completes the entire finishing process. Since the heat sink unit (element) 1' depicted in FIG. 3 is identically fabricated, its respective finishing process requires no further elaboration.

Figures 1, 2:
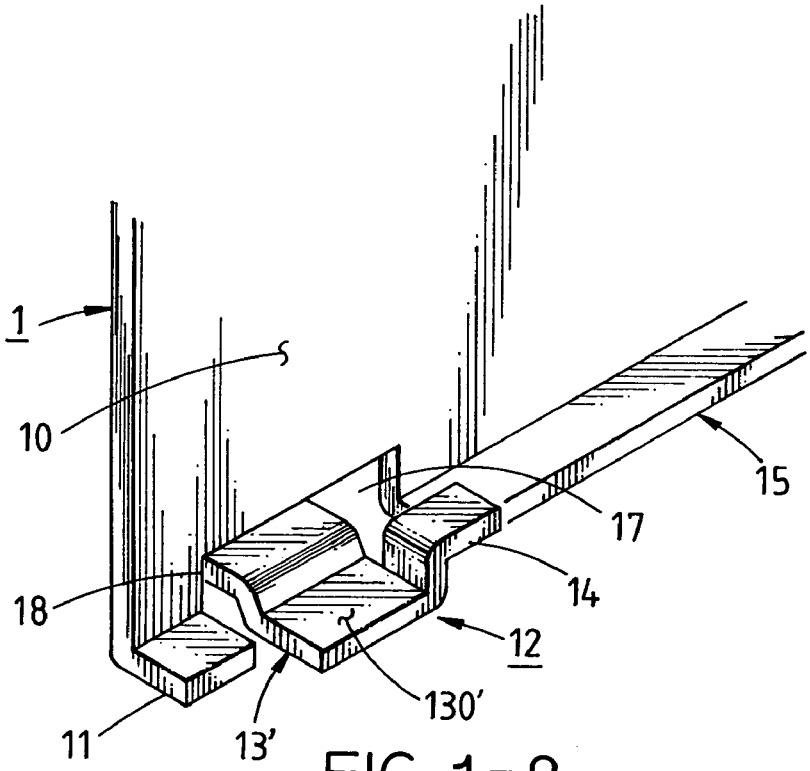
Figure 1:
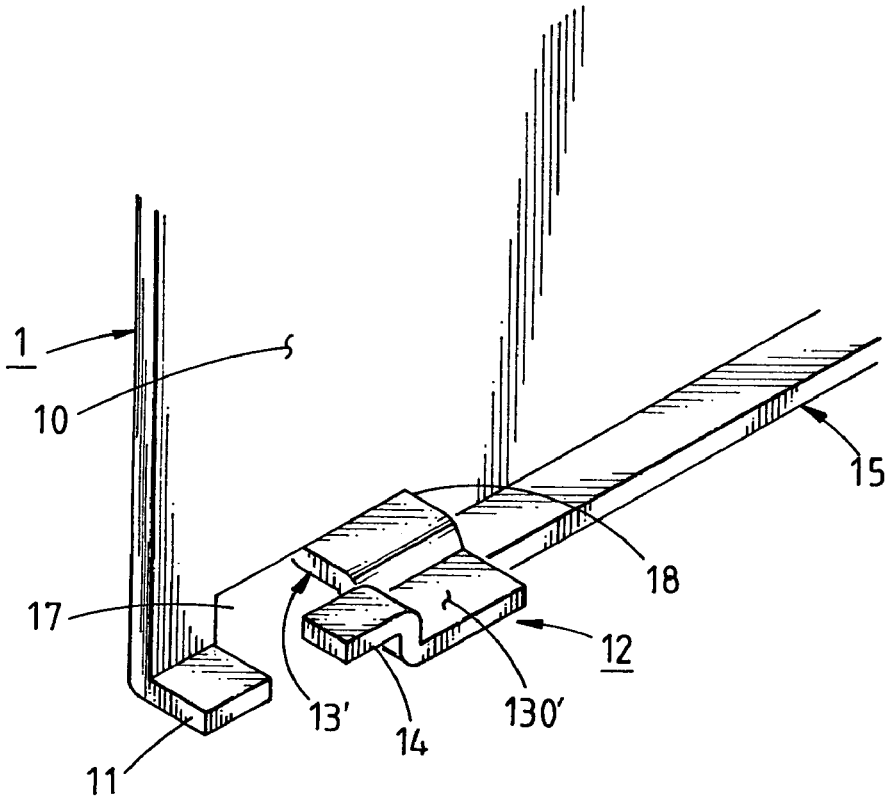
Figure 2:
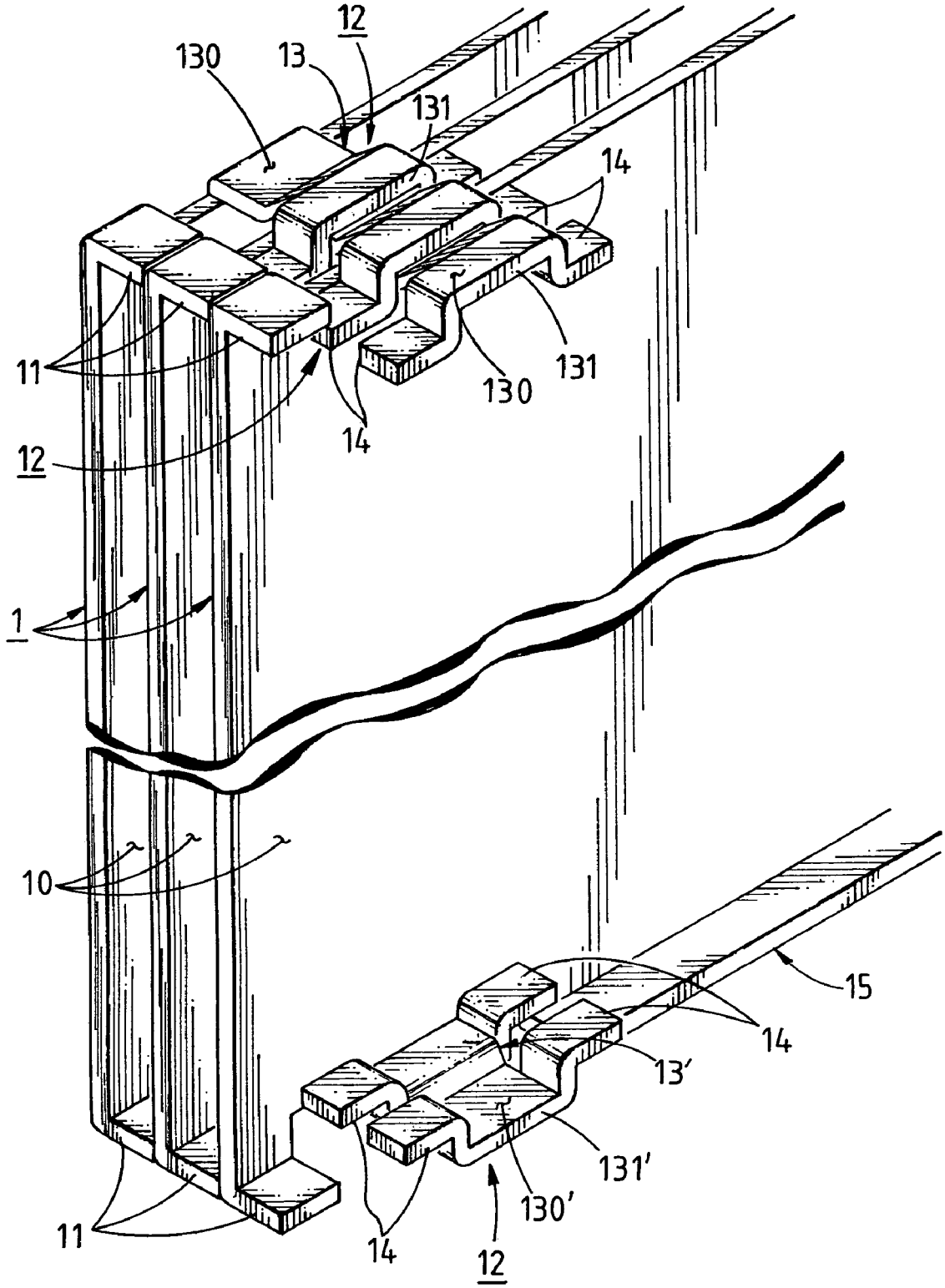

Referring to FIG. 2, when said heat sink unit (element) 1 embodiment is interconnected, it is only necessary to sequentially fit the inverted U-shaped or U-shaped appendages 131 and 131' of each coupling structure 12 at the two sides of one heat sink unit (element) 1 onto the "+" or "+"-shaped horizontal offsets 13 and 13' of the next correspondingly situated coupling structure 12 such that each wing-shaped lock tab 14 on said front heat sink unit (element) 1 becomes engaged onto the lateral edge of the adjacent other heat sink unit (element) 1 L-shaped plate 10 at fixed horizontal distances and positions, thereby interconnecting a few or numerous heat sink units (elements) 1 into an serial array of heat sink elements that provides for welding with tin, copper, or silver onto a heat sink base plate to fabricate a heat sink (not shown in the drawings). Since the heat sink unit (element) 1' is identically interconnected, the respective procedure involved is not further elaborated.

To facilitate fitting the two wing-shaped lock tabs 14 of the heat sink unit (element) 1 coupling structures 12 onto the "+" or "+"-shaped horizontal offsets 13 and 13' of the other heat sink unit (element) 1 coupling structures 12 in addition to said necessary disposing of a cutaway 17 between their horizontal offsets 13' and horizontal folds 15 to ease the engagement of the wing-shaped lock tabs 14, an horizontal fold 15' is not formed on the upper side (along one side) edge of the L-shaped plate 10 and a narrow horizontal fold 11 (as shown in FIG. 1) is disposed at a position near each said coupling structure 12 to facilitate the interconnective fixing into "position" of said L-shaped plates 10 at their upper lateral (along one side) edges (as shown in FIG. 2).

Referring to FIG. 1~1 and FIG. 1~2, since said heat sink units (elements) 1 become heat sink elements of a certain length after sequential interconnection and welding with tin, copper, or silver onto a heat sink base plate, the wing-shaped lock tabs 14 on each coupling structure 12 can, as shown in FIG. 1~1 and FIG. 1~2, be formed as a single wing-shaped lock tab 14 that only has a left or a right side but which is still sufficient to enable interconnection at fixed horizontal distances and positions; however, when the single wing-shaped lock tab 14 only has an outer side, a locating notch 18 must be punched between the horizontal offset 13' or 13 planar members 130' or 130 and the horizontally folded planar member 150 or 150' along one side of the L-shaped plate 10, and punching a cutaway 17 is not required; if the single wing-shaped lock tab 14 only has an inner side, then similarly a cutaway 17 is punched between said horizontal offset 13' planar member 130' and the horizontally folded planar member 150 or 150' along one side of the L-shaped plate 10 to facilitate the interconnective engagement of the wing-shaped lock tabs 14.

Figure 5:
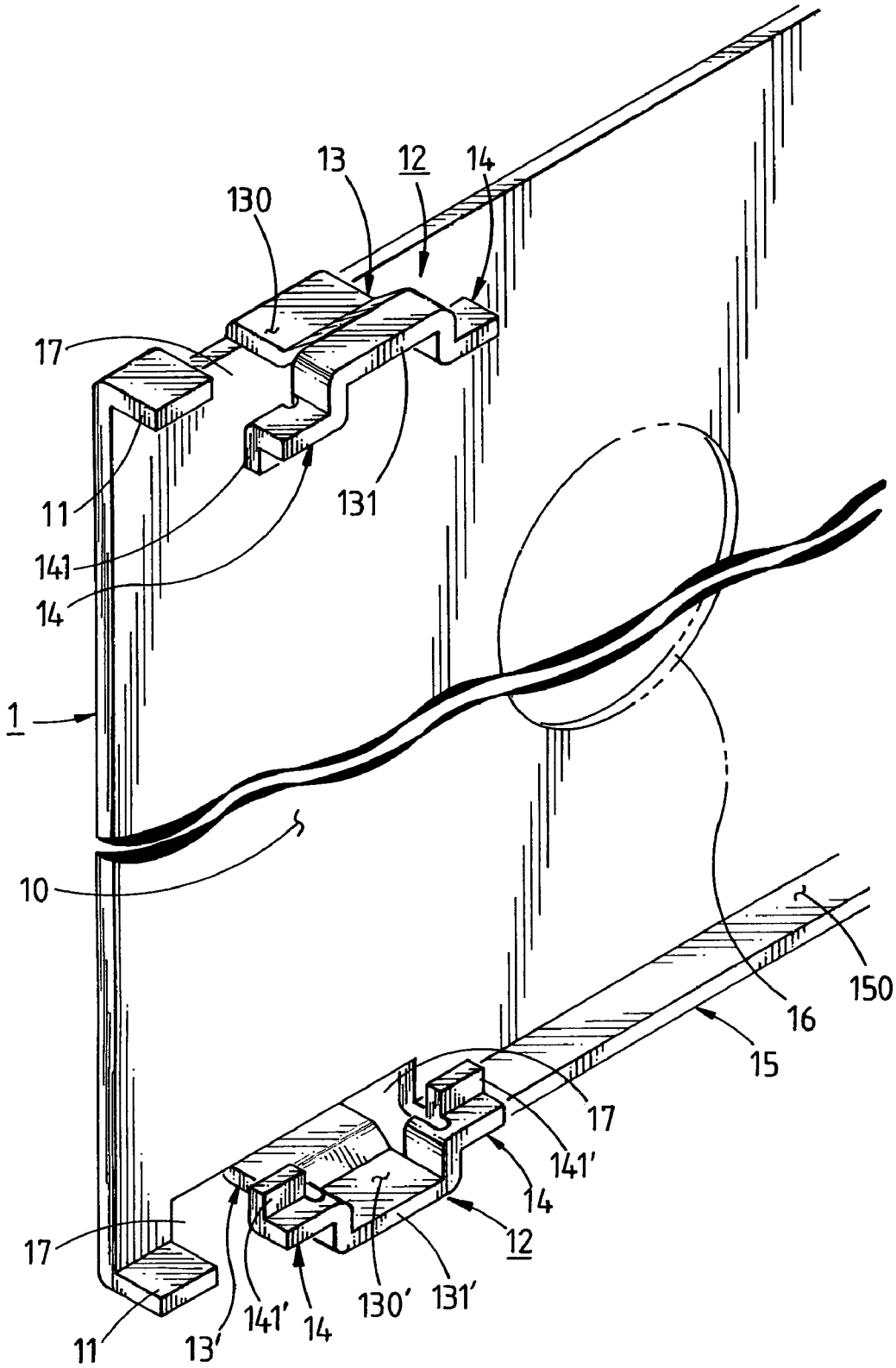
FIG. 5 is a partial isometric drawing of yet another most preferred heat sink unit (element) embodiment of the first embodiment of the invention herein, as viewed from the left side (not shown in the drawing, the right side is identical).
Figure 6:
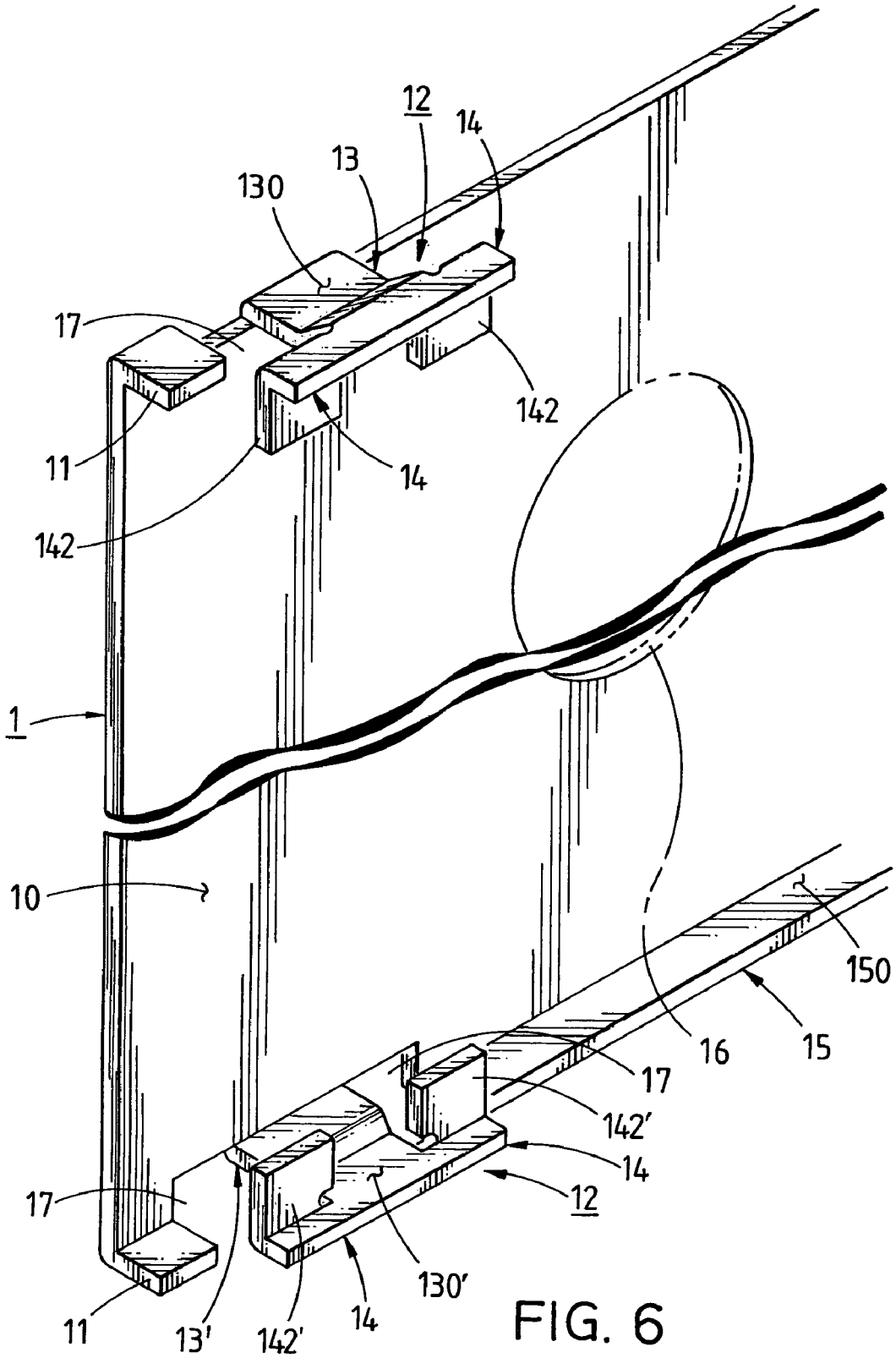
FIG. 6 is a partial isometric drawing of yet another most preferred heat sink unit (element) embodiment of the first embodiment of the invention herein, as viewed from the left side (not shown in the drawing, the right side is identical).

Referring to FIG. 5 and FIG. 6, to enable the stable attachment of the coupling structure 12 of one heat sink unit (element) 1 to the coupling structure 12 of another heat sink unit (element) 1 and ease their interconnective fixing into "position", a vertical lock edge 141 and 141' (as shown in FIG. 5) is folded downward or upward at the rear side of the two wing-shaped lock tabs 14 on each coupling structure 12; or, the anterior section of each "+" or "+"-shaped horizontal offset 13 and 13' does not have to be folded into inverted U-shaped or U-shaped appendages 131 and 131', and a vertical lock tab 142 and 142' (as shown in FIG. 6) is folded downward or upward at the rear sides of the two wing-shaped lock tabs 14; however, the width of said two vertical lock tabs 142 and 142' must match the width of said "+" or "+"-shaped horizontal offsets 13 and 13' to facilitate interconnective engagement.

Figure 7:
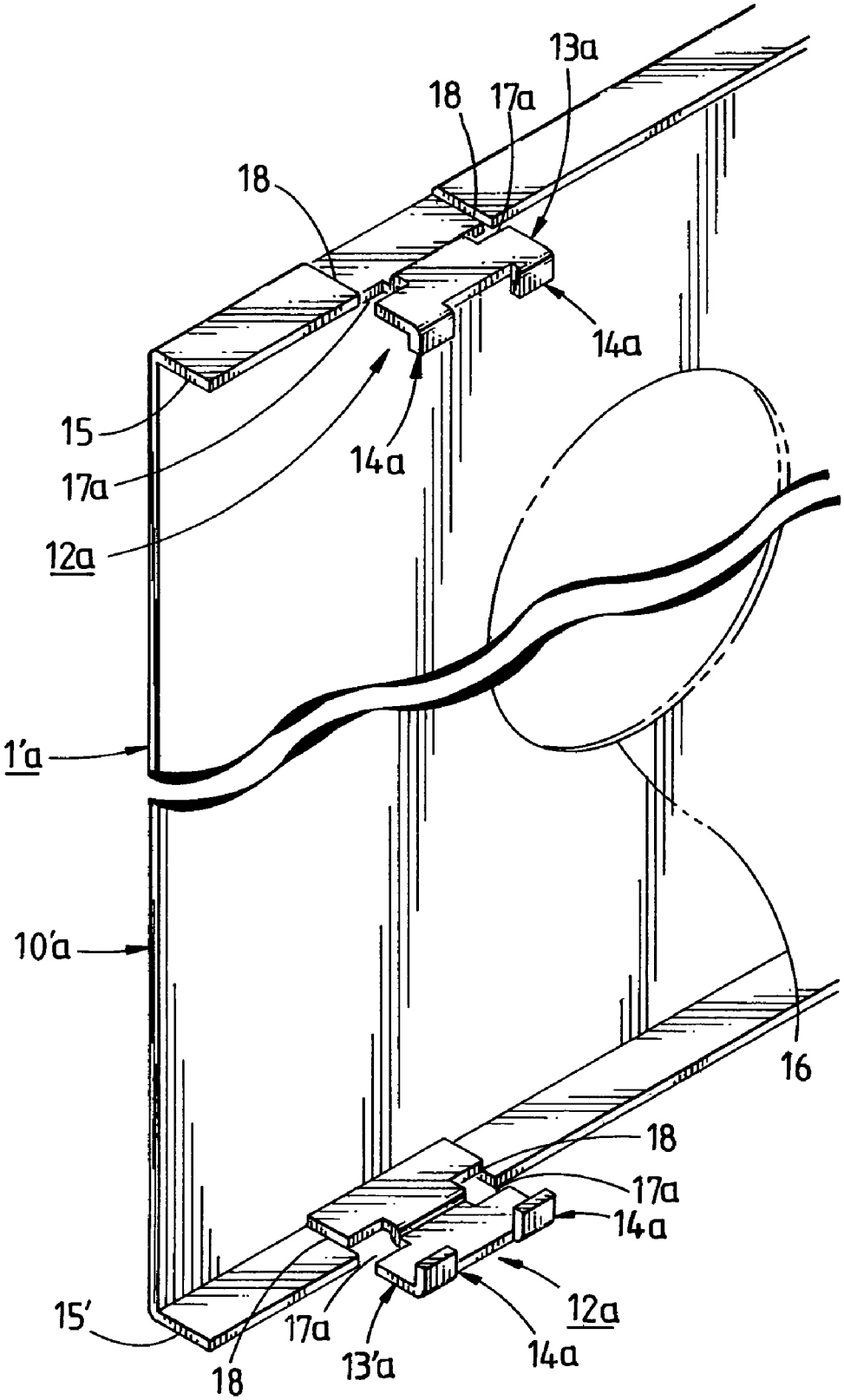
FIG. 7 is a partial isometric drawing of the second embodiment heat sink unit (element) of the invention herein, as viewed from the left side (not shown in the drawing, the right side is identical).
Figure 9:
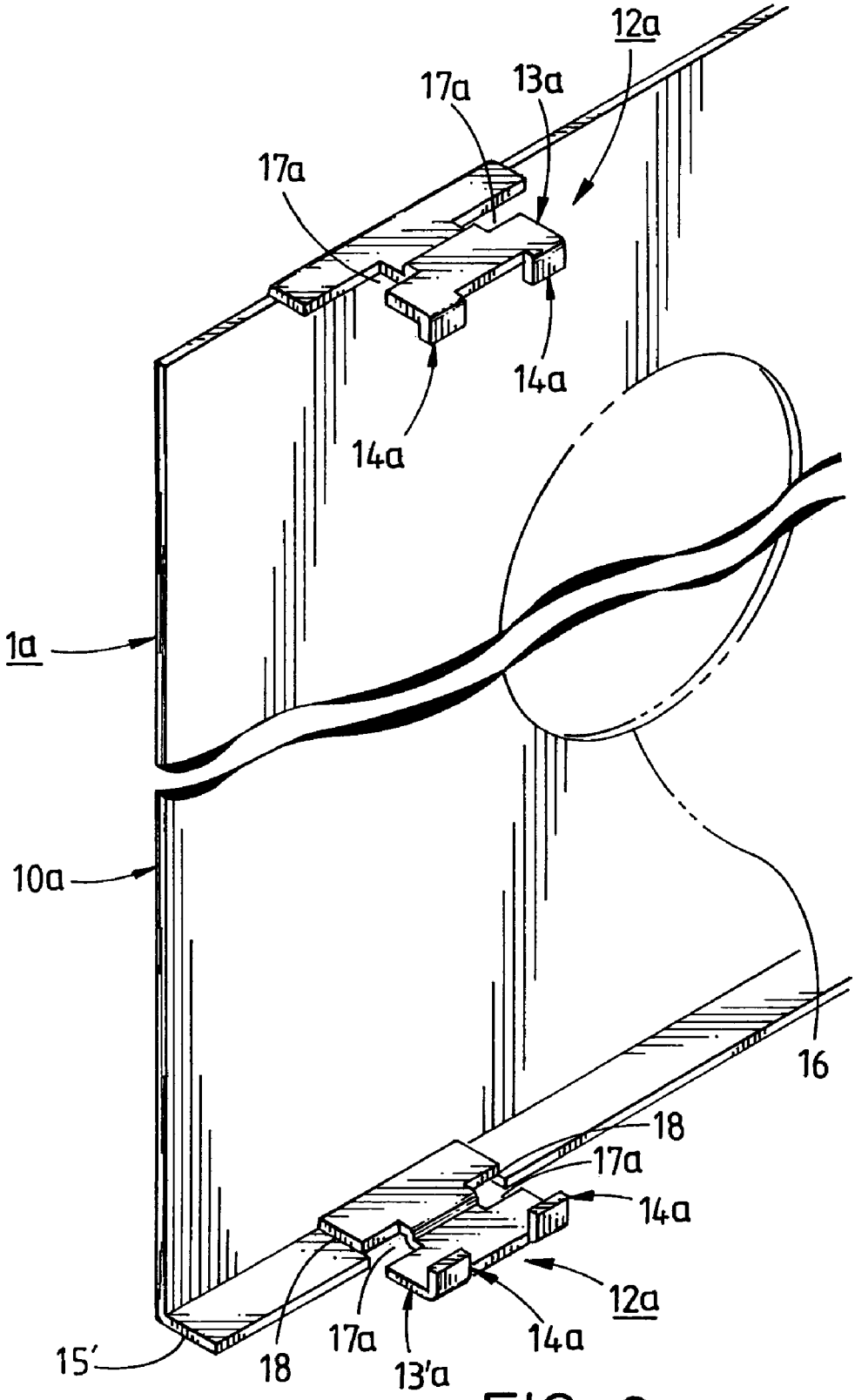
FIG. 9 is a partial isometric drawing of another most preferred heat sink unit (element) embodiment of the second embodiment of the invention herein, as viewed from the left side (not shown in the drawing, the right side is identical).

Referring to FIG. 7 and FIG. 9, the partial isometric drawings of the second embodiment heat sink unit (element) 1*a* and 1'*a*, respectively, of the invention herein, as viewed from the left side. Said heat sink element 1*a* similarly consists of an aluminum, copper, or other comparable metal material that is punch fabricated into shape. Furthermore, it also consists of a horizontally oriented U-shaped plate 10'*a* of appropriate dimensions having an horizontal fold 15 and 15' formed along two lateral edges (the upper and lower or left and right), or a horizontally oriented U-shaped plate 10'*a* having a plurality of additionally punched holes 16; or an L-shaped plate 10*a* of appropriate dimensions having an horizontal fold 15' formed along one lateral edge (the upper, lower, left, or right lateral edge) or an L-shaped plate 10*a* having a plurality of additionally punched holes 16; a minimum of one or more coupling structures 12 is disposed on the two sides (upper and lower ends or left and right ends) or a suitable position at the center portion of said plates 10*a* and 10'; a "+" or a "+"-shaped horizontal offset 13*a* and 13'*a* is formed by bending the two sides of each coupling structure 12 at the upper and lower or left and right lateral edge of said horizontally oriented U-shaped plate 10'*a* or the L-shaped plate 10*a*, a cutaway 17*a* is punched fabricated at the two sides or either the left or the right side (as shown in FIG. 6) of said horizontal offsets 13*a* and 13'*a*, and a lock tab 14*a* is punch formed downward or upward at the two sides or the either left or right of the anterior section.

Figure 8:
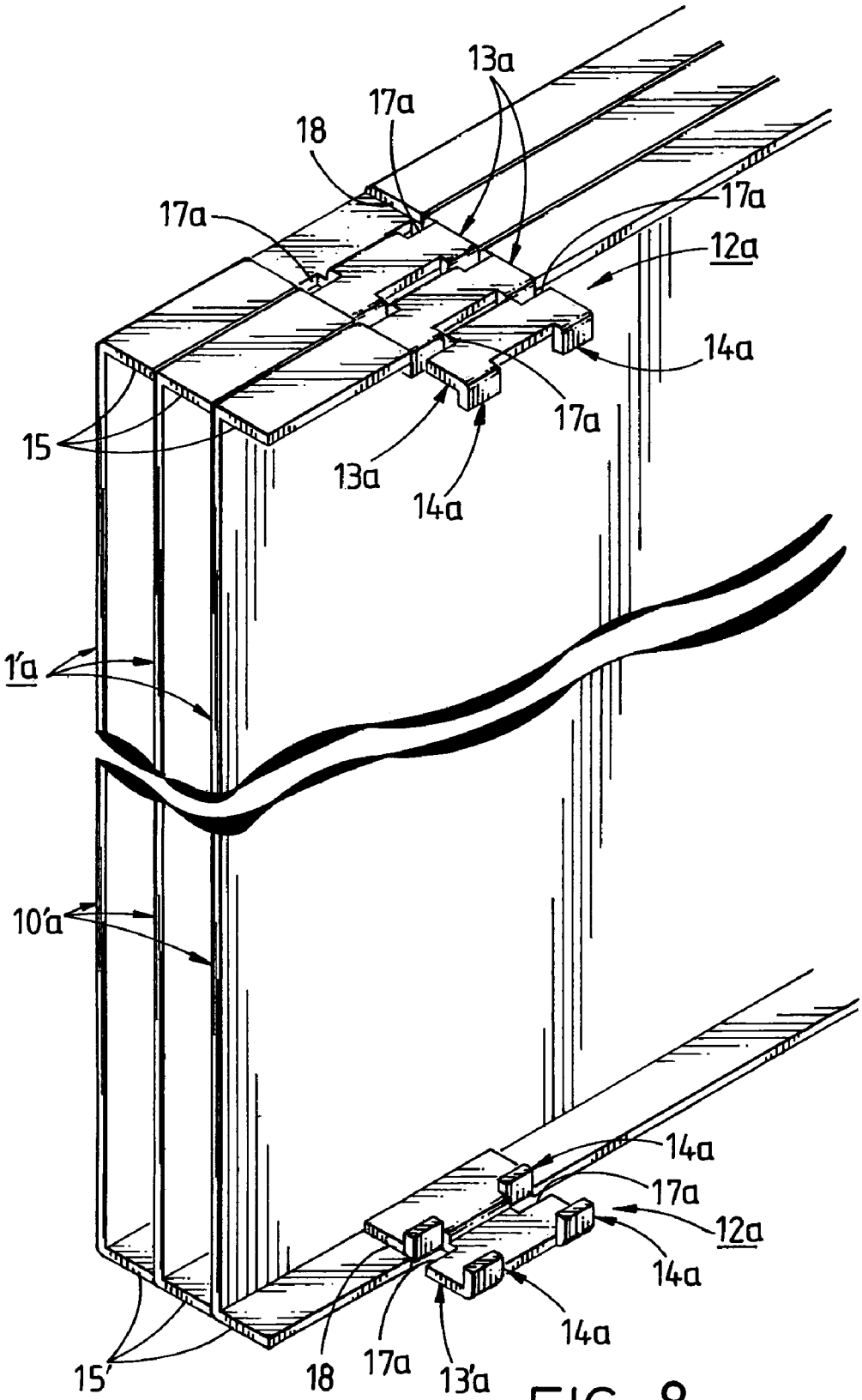
FIG. 8 is a partial isometric drawing of the heat sink unit (element) embodiment shown in FIG. 7 during interconnection, as viewed from the left side (not shown in the drawing, the right side is identical).

Referring to FIG. 8, when the second embodiment heat sink unit (element) 1' of the invention herein is interconnected, it is only necessary to sequentially fit the horizontal offsets 13*a* and 13'*a* of each coupling structure 12*a* at the two sides of one heat sink unit (element) 1' onto the horizontal offsets 13*a* and 13'*a* of the next correspondingly situated coupling structure 12*a* on another adjacent heat sink unit (element) 1'*a* such that the lock tabs 14 on said front heat sink unit (element) 1' become engaged onto the cutaway 17*a* at the two sides of said other adjacent heat sink unit (element) 1'*a* upper and lower horizontal offsets 13*a* and 13'*a* at fixed horizontal distances and positions, thereby interconnecting a few or numerous heat sink units (elements) 1 into a serial array of heat sink elements that provides for welding with tin, copper, or silver onto a heat sink base plate to fabricate a heat sink (not shown in the drawings). Since the interconnection method of the heat sink unit (element) 1*a* and the heat sink unit (element) 1' is identical, the procedure involved is not further elaborated.

Figure 10:
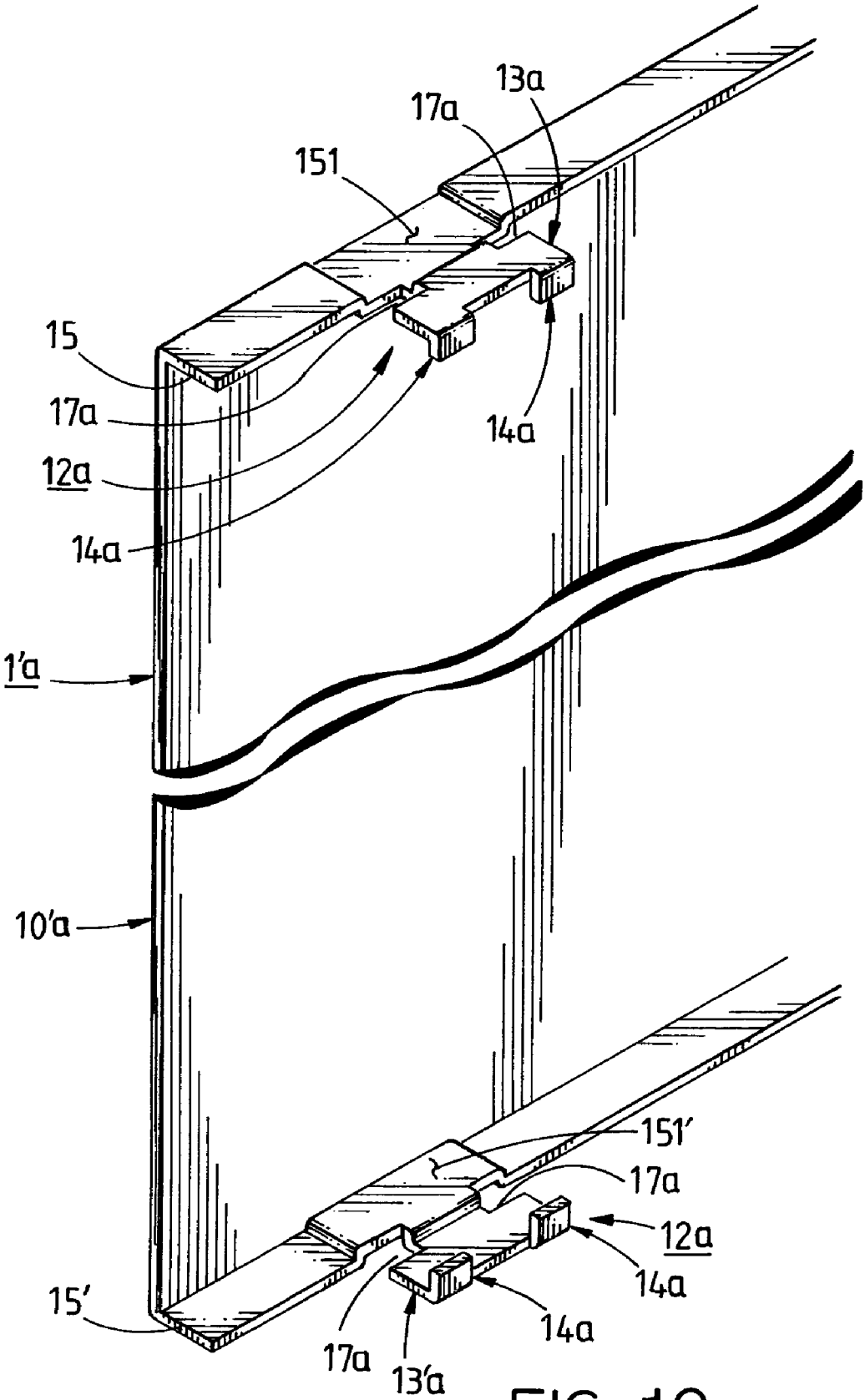
FIG. 10 is a partial isometric drawing of a different most preferred heat sink unit (element) embodiment of the second embodiment of the invention herein, as viewed from the left side (not shown in the drawing, the right side is identical).
Figure 11:
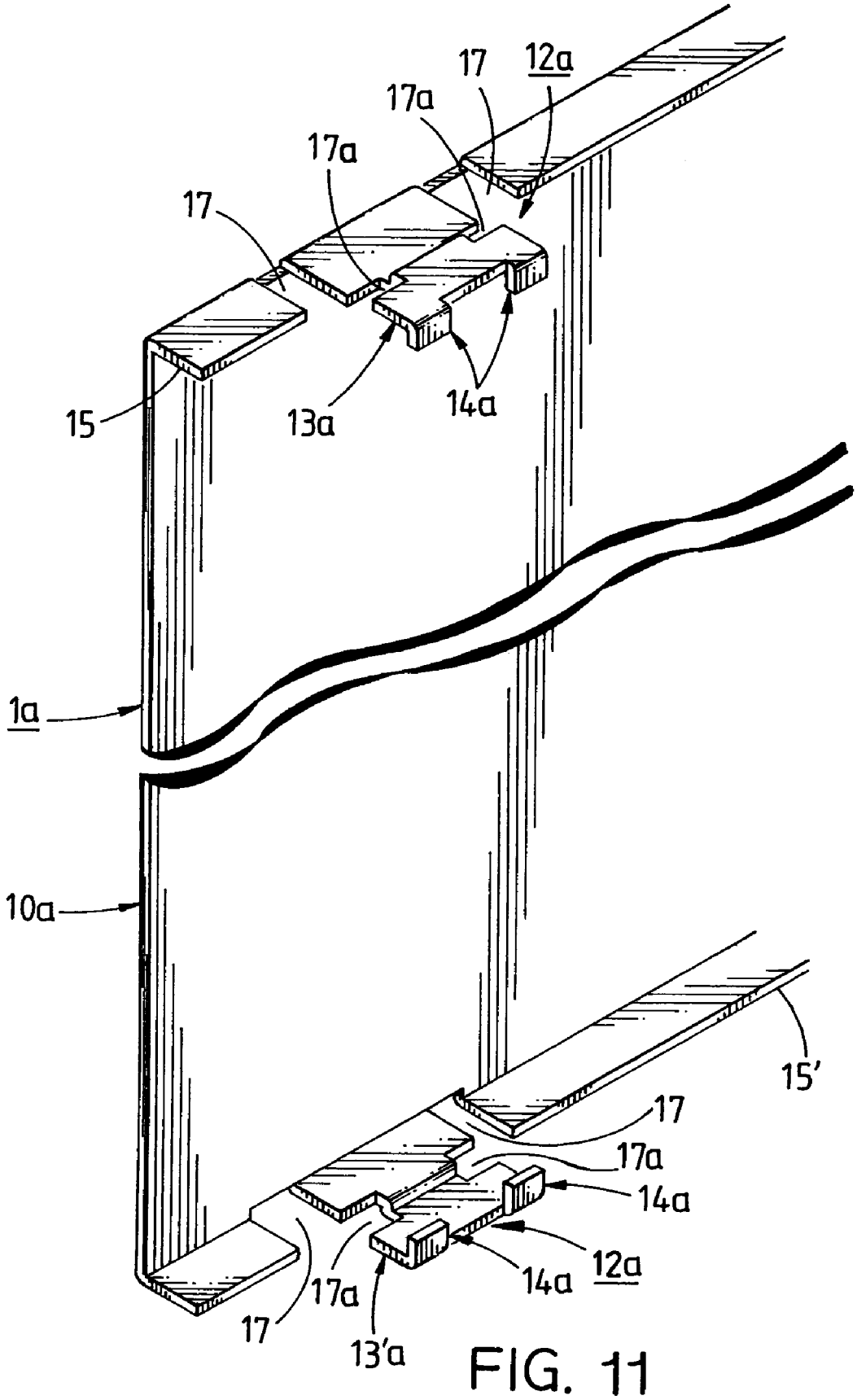
FIG. 11 is a partial isometric drawing of a different most preferred heat sink unit (element) embodiment of the second embodiment of the invention herein, as viewed from the left side (not shown in the drawing, the right side is identical).
Figure 12:
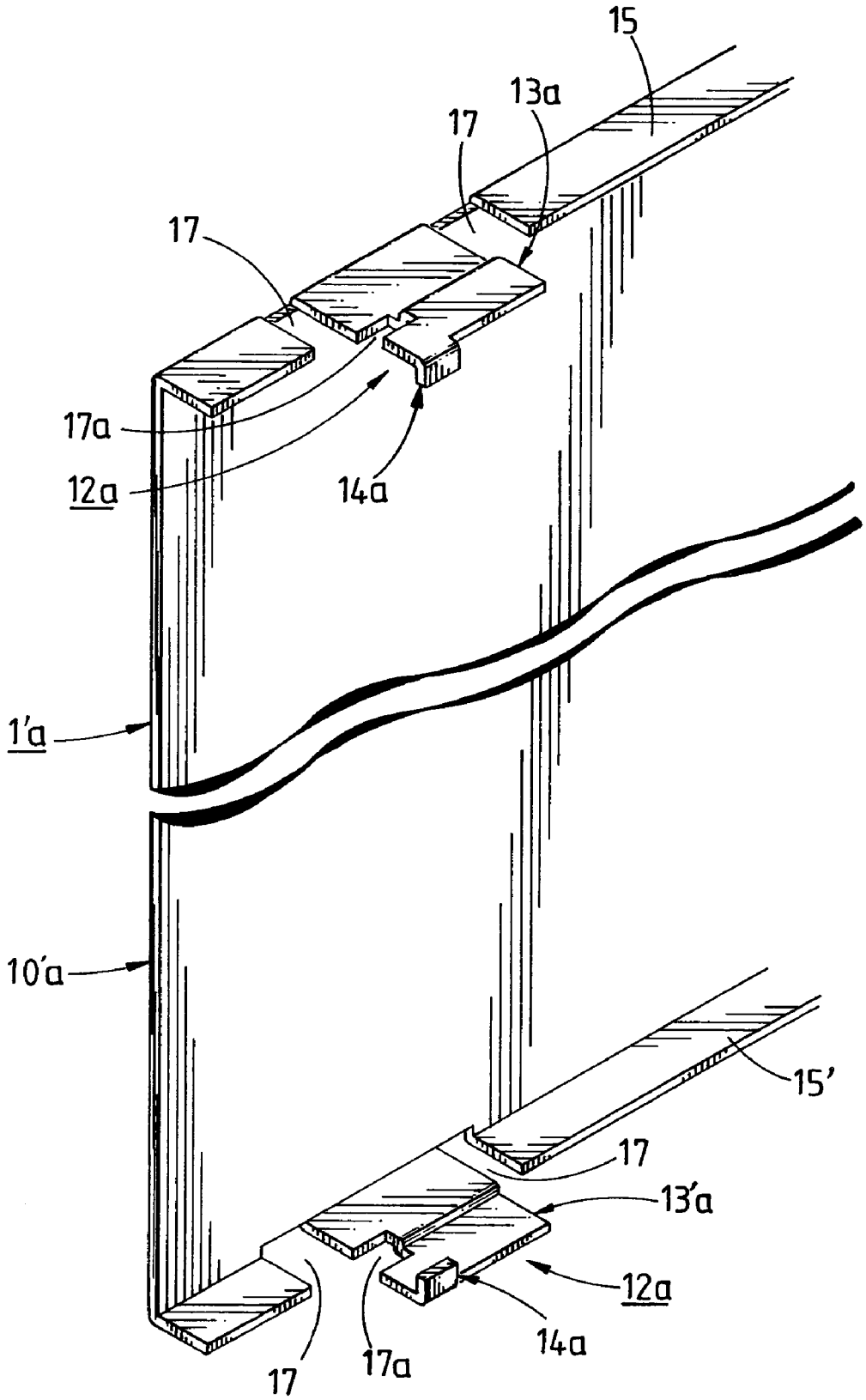
FIG. 12 is a partial isometric drawing of a different most preferred heat sink unit (element) embodiment of the second embodiment of the invention herein, as viewed from the left side (not shown in the drawing, the right side is identical).

Since the second embodiment heat sink unit (element) 1'*a* (as shown in FIG. 7) of the invention herein consists of a horizontally oriented U-shaped plate 10'*a* of appropriate dimensions having an horizontal fold 15 and 15' formed along the upper and lower edges, the posterior half sections of the upper and lower horizontal offsets 13 and 13' on each coupling structure 12*a* can be punch fabricated from said upper and lower horizontal folds 15 and 15'. As indicated in FIG. 7 and FIG. 10, the punch fabrication approach includes: first punching two locating notches 18 in said horizontal folds 15 and 15' followed by forming the upper and lower horizontal offsets 13*a* and 13'*a*; or, first punching downward and upward indentations 151 and 151' in said horizontal folds 15 and 15' and then forming said upper and lower horizontal offsets 13 and 13' (as shown in FIG. 10); or, first punching two cutaways 17 in said horizontal folds 15 and 15' followed by forming said upper and lower horizontal offsets 13 and 13' (as shown in FIG. 11). As for the other heat sink unit (element) 1*a* arrangement (shown in FIG. 9) of the second embodiment of the invention herein, the L-shaped plate 10*a* only has an horizontal fold 15' formed along its lower edge. Thus, the horizontal offset 13*a* on each coupling structure 12 is directly punch formed as an extension from the top edge of the L-shaped plate 10; furthermore, the posterior half section of the lower horizontal offset 13' is similarly first punched from said lower horizontal fold 15'; and after the two locating notches 18 and the two cutaways 17 or the upward indentation 151' are articulated, said lower horizontal offset 13' is punch formed.

The invention claimed is:

1. A heat sink element coupling structure (2), its single heat sink element plate comprised of an L-shaped plate having a horizontal fold formed along one lateral edge or a horizontally oriented U-shaped plate having horizontal folds formed along two lateral edges, including a minimum of one or more coupling structures disposed on the upper and lower or left and right sides or a certain position at the center portion of said plates, the features of which are:

said coupling structure consists consisting of:

an ascending-stepped or a descending-stepped horizontal offset formed on the lateral edge of said plates;

an inverted U-shaped or a U-shaped appendage situated at the anterior section of said ascending-stepped or said descending-stepped horizontal offsets offset;

one or two wing-shaped lock tabs formed at the two sides or either the left or the right side of said inverted U-shaped or said U-shaped appendage;

when interconnected, one or two said wing-shaped lock tabs of each said coupling structure at the two sides of one heat sink unit (element) are fitted onto said ascending-stepped or descending-stepped horizontal offsets of the next correspondingly situated said heat sink unit (element) such that the one or two said wing-shaped lock tabs on said front heat sink unit (element) becomes engaged onto the lateral edge of the adjacent other said heat sink unit (element) at fixed horizontal distances and positions.

2. As mentioned in claim 1 of the heat sink element coupling structure (2), wherein each said wing-shaped lock tab has a vertical lock edge disposed downward or upward on its rear side.

3. As mentioned in claim 1 of the heat sink element coupling structure (2), wherein the anterior section of each said ascending-stepped or descending-stepped horizontal offset does not have to be folded into said inverted U-shaped or U-shaped appendage, and a vertical lock tab is folded downward or upward at the rear sides of said wing-shaped lock tabs.

4. As mentioned in claims 1, 2 or 3 of the heat sink element coupling structure (2), wherein each said coupling structure only has a single said wing-shaped lock tab at the anterior half sections of its said "+" ascending-stepped or descending-stepped horizontal offsets.

5. As mentioned in claim 4 of the heat sink element coupling structure (2), wherein a cutaway is disposed between said ascending-stepped or descending-stepped horizontal offset having a single said wing-shaped lock tab at the inner side thereof and said L-shaped or horizontally oriented L-shaped plates; disposed between said horizontal offset having a single said wing-shaped lock tab at the outer side thereof and said horizontal fold formed along said L-shaped or horizontally oriented U-shaped plates is a locating notch.

6. As mentioned in claims 1 or 3 of the heat sink element coupling structure (2) invention herein, said L-shaped plate lacks a said horizontal fold and has a minimum of one narrow horizontal fold disposed at a position near a said coupling structure.

7. The heat sink element coupling structure (2) of claim 1 wherein the posterior half sections of said ascending-stepped or descending-stepped horizontal offsets include first disposing two locating notches, or two cutaways, or downward and upward indentations on their upper and lower said horizontal folds and then forming the said ascending-stepped or descending-stepped horizontal offsets.

8. As mentioned in claim 1 of the heat sink element coupling structure (2), said L-shaped plate or said horizontally oriented U-shaped plates has a plurality of holes.

* * * * *